US005690266A

United States Patent [19]

Klinga

[11] Patent Number: 5,690,266

[45] Date of Patent: Nov. 25, 1997

[54] STAPLING DEVICE

[75] Inventor: Bengt Klinga, Tyresö, Sweden

[73] Assignee: Tolerans Ingol Sweden AB, Tyresö, Sweden

[21] Appl. No.: 714,875

[22] Filed: Sep. 17, 1996

Related U.S. Application Data

[63] Continuation of Ser. No. 196,484, Feb. 15, 1994, abandoned.

[30] Foreign Application Priority Data

Feb. 18, 1993 [SE] Sweden ..... 93 00537

[51] Int. Cl.[6] ..... B27F 7/21; B27F 7/23

[52] U.S. Cl. ..... 227/81; 227/88; 227/91; 227/100

[58] Field of Search ..... 227/1, 81, 88, 227/91, 99, 100; 112/121.14; 270/37, 53

[56] References Cited

U.S. PATENT DOCUMENTS

| | | | |
|---|---|---|---|
| 765,911 | 7/1904 | Balze | 270/53 |
| 3,223,304 | 12/1965 | Chaffee et al. | 227/81 |
| 3,497,126 | 2/1970 | Olsson . | |
| 3,762,622 | 10/1973 | Noren | 227/81 |
| 3,763,799 | 10/1973 | Bottcher | 227/81 X |
| 4,223,823 | 9/1980 | Kutzner et al. | 227/81 |
| 4,850,520 | 7/1989 | Schumann et al. . | |
| 5,284,466 | 2/1994 | Magnusson et al. | 227/81 X |
| 5,390,905 | 2/1995 | Melchoir | 270/37 X |

FOREIGN PATENT DOCUMENTS

| | | |
|---|---|---|
| 2058400 | 7/1971 | Germany . |
| 323672 | 5/1970 | Sweden . |

*Primary Examiner*—Rinaldi I. Rada
*Assistant Examiner*—Boyer Ashley
*Attorney, Agent, or Firm*—Burns, Doane, Swecker & Mathis, L.L.P.

[57] ABSTRACT

The invention relates to a device for stapling to a material (1) at predetermined distances along a web formed by the material with the aid of a stapling cylinder (2), a counterpressure cylinder (3), a forming drum (4) and a horn (5) which extends around the periphery of the stapling cylinder between the forming drum and the counterpressure cylinder, wherein the stapling cylinder (2) coacts with a stapling fork (6) which is intended to cut a staple-forming section from wire-like material (10) in a region (B) between the stapling cylinder (2) and the forming drum (4) and to form therefrom a U-shaped staple which can be carried by the stapling cylinder (2) to a region (A) between the stapling cylinder (2) and the counterpressure cylinder (3) and there fastened to a material web (1) passing between the stapling cylinder (2) and the counterpressure cylinder (3). The stapling fork (6), at least in the region (B) between the stapling cylinder (2) and the forming drum (4), is intended to move along a first path section (11) and therewith cut and form a staple (7). The stapling fork (6), at least in the region (B) between the stapling cylinder (2) and the forming drum (4), is intended to be able to move along a second path section (12) in dependence on the occurrence of an activating signal and therewith prevent cutting of the wire-like material (10) and the formation of a U-shaped staple (7), or vice versa.

11 Claims, 3 Drawing Sheets

STAPLING DEVICE

This is a continuation of application Ser. No. 08/196,484, now abandoned.

TECHNICAL FIELD

The present invention relates generally to a stapling device by means of which one or more staples can be driven through a material surface, and more particularly to a device for stapling together material at predetermined distances along a material web, normally a continuous web.

The inventive device is based on the use of a stapling cylinder, a counterpressure cylinder, a forming drum, a horn which extends between the forming drum and the counterpressure cylinder and around the stapling cylinder, a stapling fork mounted in the region between the stapling cylinder and the forming drum and functioning to cut wire-like material into sections from which a staple is formed and subsequently to form a U-shaped staple, said staple being conveyed by the stapling cylinder to the region between said stapling cylinder and the counterpressure cylinder and there fastened to a material web that passes between the stapling cylinder and the counterpressure cylinder.

The stapling fork is intended to move along a path in said region between the stapling cylinder and the forming drum and therewith cut and form a staple.

A stapling device, or a cylinder stitching machine, of the aforedescribed kind is used to staple together the fine parts of multi-page newspapers, magazines or the like, and constitutes one processing station among several processing stations in which printed products leaving a printing machine are processed.

The printed paper material is folded in various ways to form a newspaper, magazine or the like and the separate pages are stapled together along their spine-forming parts.

BACKGROUND ART

A stapling device for applying staples at predetermined distances along a material web and being of the kind defined above is known from a rotary newspaper stapling machine sold by Tolerans Ingol Sweden AB, Tyresö, Sweden.

A rotary stapling machine sold under the designation "Tolerans" is constructed to apply staples sequentially at varying distances along the material web, these distances comprising a multiple of the stapling cylinder circumference.

To this end, the wire sections from which the staples are formed are fed-in intermittently at locations where a staple is to be applied.

A rotary stapling machine of the kind sold under the designation "Ingol" is thus adapted to apply mutually sequential staples at varying distances along the material web.

To this end, the machine includes means which are intended to lift wire sections and their holding devices with wire feed means from a cutting position, in which the stapling fork passes the forming drum, and are lowered to a cutting position when a staple is to be applied.

SUMMARY OF THE PRESENT INVENTION

Technical Problems

When studying the present standpoints of techniques with regard to stapling machines, it will be seen that a technical problem resides in providing one and the same device with simple means that will enable staples to be applied at predetermined short distances along a web and to enable staples to be applied at spacings which equal two times, three times, etc., this distance.

It will also be seen that a technical problem resides in enabling this possibility to be realized with relatively small modifications and new constructions in the earlier known rotary stapling machines, with which the distance between the staples applied can be selected solely by generating an activating signal.

It will also be seen that a further technical problem is one of realizing the advantages that are afforded when in the absence of an activating signal the stapling fork is caused to move in the region between the stapling cylinder and the forming drum along a first path section which is so curved or configured as to effect cutting and bending of the wire-like material so as to form a U-shaped staple, and upon the occurrence of an activating signal is caused to move along a second path section which is so configured or curved as to prevent cutting of said wire-like material and therewith also the formation of a U-shaped staple.

It will also be seen that a technical problem resides in understanding the significance of causing the stapling fork to move along said second path section in the region between the stapling cylinder and the forming drum in a manner which deviates from a circular line, for movement directed towards the central part of the stapling cylinder.

Another technical problem resides in realizing the significance of enabling a shorter path section along which the stapling fork is intended to move to take either one of two possible positions, so that said stapling fork will move along either one of said two path sections according to the position chosen.

Another technical problem is one of realizing the significance of generating the activating signal in a control circuit so that said signal will occur during time periods in which the stapling fork passes the region between the stapling cylinder and the forming drum.

Still another technical problem is one of realizing the advantages that are afforded when upon the occurrence of an activating signal with each alternate revolution, the feed rate of the wire which is to form the U-shaped staple is chosen to be half the wire feed rate that is applicable in the absence of an activating signal, and upon the occurrence of an activating signal during two sequential revolutions, the selected wire feed rate that is one-third of the feed rate applicable in the absence of an activating signal, and so on.

Solution

The present invention provides a solution to one or more of the aforesaid technical problems and is based on a device for applying staples to materials at predetermined distances along a material web, said device comprising a stapling cylinder, a counterpressure cylinder, a forming drum, a horn which extends between the forming drum and the counterpressure cylinder around the peripheral surface of the stapling cylinder, and a stapling fork which coacts with the stapling cylinder to cut wire-like material in the region between the stapling cylinder and the forming drum and form a U-shaped staple, said staple being carried by the stapling cylinder and the stapling fork to the region between the stapling cylinder and the counterpressure cylinder and there fastened to a material web passing between the stapling cylinder and the counterpressure cylinder, wherein the stapling fork, at least in the region between the stapling cylinder and the forming drum, is intended to move along a first path section and therewith cut and form a staple.

In accordance with the invention, it is proposed that the stapling fork of said device is able to move along a second path section, at least in the region between the stapling cylinder and the forming drum, in response to the occurrence of an activating signal, therewith to prevent cutting of said wire-like material and the formation of a U-shaped staple.

According to preferred embodiments that lie within the scope of the inventive concept, the stapling fork shall be able to move in the region between the stapling cylinder and the forming drum along a path which deviates from a circular line so that the stapling fork will move towards the central part of the stapling cylinder.

It is also proposed that a path section shall take one of two possible positions, i.e. one position in which the stapling fork will move along a first path section in which said wire-like material is cut and formed into a U-shaped staple, and a position in which the, stapling fork is caused to move along a second path section in which it is prevented from cutting said wire-like material and forming a U-shaped staple.

It is also proposed that the activating signal is produced by a control circuit at least during those time sections in which the stapling fork passes the region between stapling cylinder and forming drum.

It is also suggested that upon the occurrence of an activating signal with each alternative resolution, the wire is fed at a speed which is half the wire feed speed that applies in the absence of an activating signal, and upon the occurrence of an activating signal during two sequential revolutions, the wire is fed at a speed which is one-third of the speed at which the wire is fed in the absence of an activating signal, and so on.

It is also proposed that the first path section and the second path section are comprised of mutually parallel, different path sections, where the first path section is arranged for movement between a first position adjacent the second path section and a second position in which it is distanced from said second path section.

Finally, it is proposed that the stapling fork is adapted to move on a runner along a circular path or an essentially circular path as the stapling cylinder rotates.

Advantages

Those advantages primarily afforded by the inventive device reside in the provision of conditions which enable the distance between mutually sequential staples applied to a material web to be chosen as an even multiple of the circumference or periphery of a stapling cylinder.

BRIEF DESCRIPTION OF THE DRAWINGS

An exemplifying embodiment at present preferred and having significant features characteristic of the present invention will now be described in more detail with reference to the accompanying drawings, in which.

DESCRIPTION OF EMBODIMENTS AT PRESENT PREFERRED

Figure 1:
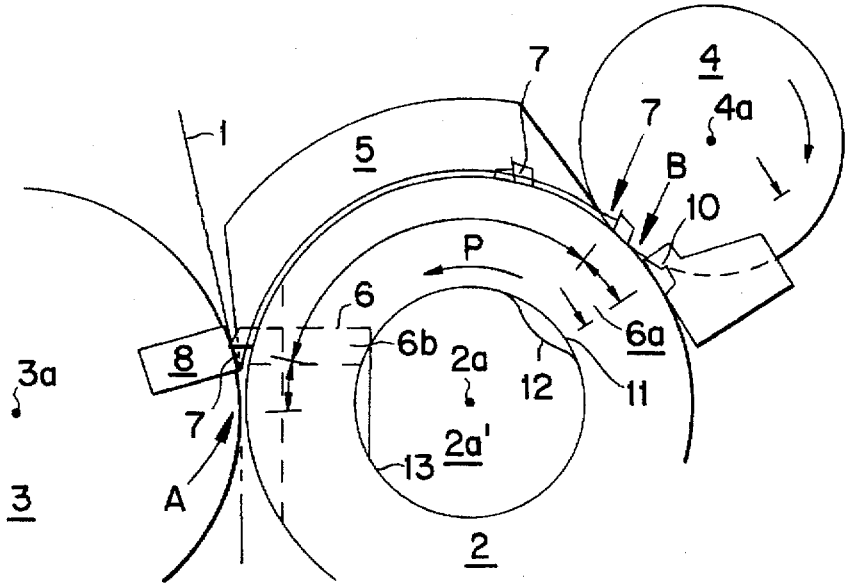
FIG. 1 illustrates in side view the principle construction of an inventive device comprising a stapling cylinder, a counterpressure cylinder and a forming drum.

FIG. 1 is a greatly simplified illustration in side view of a device for applying staples to material 1 at predetermined distances along a continuous web formed by said material.

To this end, the device includes a stapling cylinder 2 which is mounted for rotation about a centre axis 2*a* in the direction of the arrow "P", a counterpressure cylinder 3 which is mounted for rotation about a centre axis 3*a*, and a forming drum 4 which is mounted for rotation about a centre axis 4*a*.

The illustrated device also includes a disc-like horn 5 which extends around the upper peripheral surface of the stapling cylinder 2 between the forming drum 4 and the counterpressure cylinder 3 and the width of which is adapted to the distance between the legs of a U-shaped staple, when the same is in coaction with the stapling cylinder 2 and accompanies the rotary movement of said cylinder. The stapling fork 6 functions to press the legs of a staple 7 through the paper web 1 in the region A, shown in FIG. 1, against an anvil 8 mounted on the counterpressure cylinder 3.

The stapling fork 6 accompanies rotation of the stapling cylinder 2 and is able to take a position 6*a* in the region between the stapling cylinder 2 and the forming drum 4 in which it is able to cut a staple forming section from the wire-like material 10 and, at the same time, shape said section into a U-shaped staple 7. This staple can be carried by the stapling cylinder to the region A between the stapling cylinder and the counterpressure cylinder and there fastened to a material web 1 passing between said stapling cylinder and said counterpressure cylinder. As the stapling cylinder 2 rotates, the stapling fork 6 rides on a guiding surface 13 positioned coaxially within a recess in the cylinder, as shown in FIG. 1. As further described below, the guiding surface 13 includes controllable segments 11 and 12 for selectively activating the stapling fork 6.

The stapling fork 6 is intended, at least in the region B between the stapling cylinder and the forming drum, to move along a part-circular path section 11, so as to cut and shape a staple 7.

Figure 2:
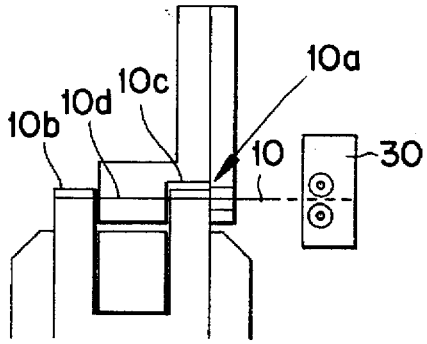
FIG. 2 illustrates in side view and in larger scale than in FIG. 1 a stapling fork positioned in the region between the stapling cylinder and the forming drum.

FIG. 2 illustrates how the wire-like material 10 is cut at a section 10*a*, wherewith shorter sections 10*b* and 10*c* are used to form the legs of the U-shaped staple, which has an intermediate leg-connecting part 10*d* whose length is adapted to the width of the horn 5.

Thus, according to the invention, the stapling fork 6, at least in the region B between the stapling cylinder and the forming drum, is able to move either along a first path section 11 or along a second path section 12 in dependence on the occurrence or absence of an activating signal.

When the stapling fork 6 moves along the second path section 12, it is prevented from cutting the wire-like material 10 and forming a U-shaped staple, because the stapling fork 6 will move in a direction towards the centre 2*a* of the stapling cylinder and therewith pass beneath the location of the wire 10.

In the region B between the stapling cylinder 2 and the forming drum 4, the stapling fork 6 is thus moved along the second path section 12 which deviates slightly from a circular line.

In this case, the stapling fork 6 moves more or less towards the central part 2a' of the stapling cylinder.

Figure 3:
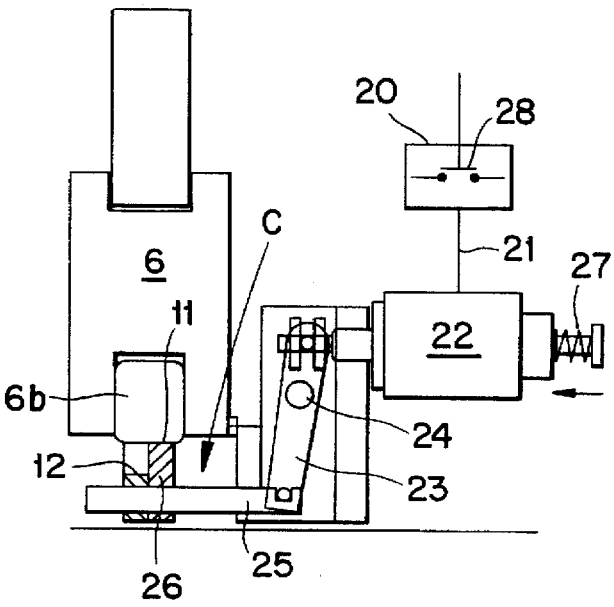
FIG. 3 is a side view, partly in section, of an arrangement which enables one of two available path sections to be chosen in response to an activating signal.
Figure 4A:
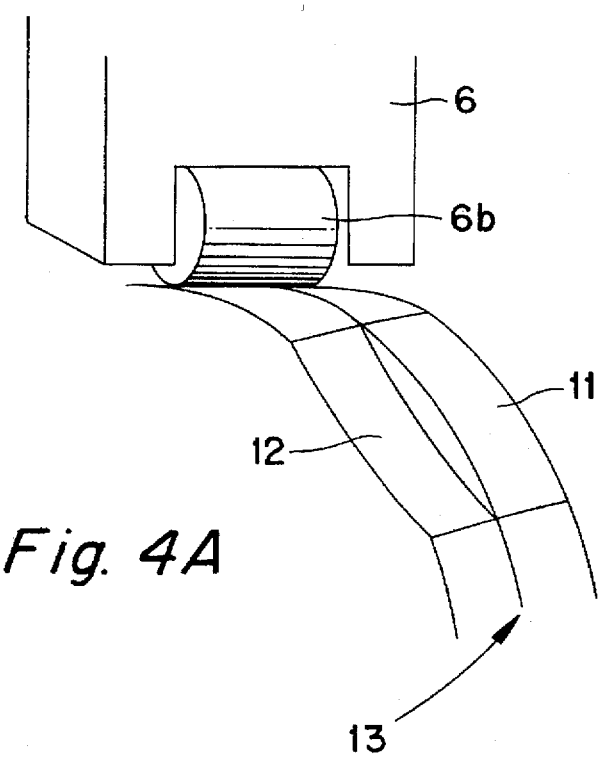
FIGS. 4*a* and 4*b* are perspective views illustrating the relationship of the stapling fork 6 and selectable path sections 11, 12; and, FIG. 5 shows an on-line application in a printing press.
Figure 4B:
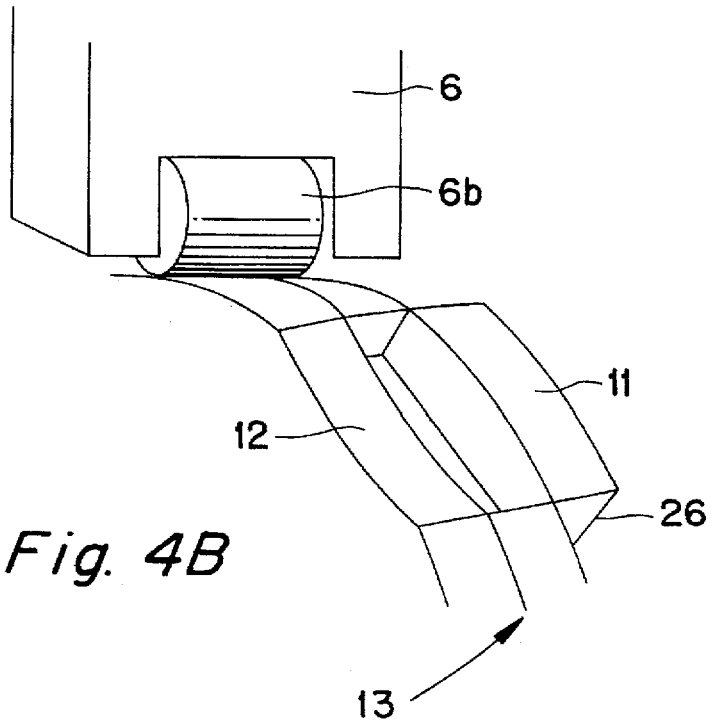

As illustrated in FIGS. 3, 4A and 4B, the inventive device also includes a guide path 13 which cooperates with a circular track of a wheel or runner 6b belonging to the stapling fork 6. A path section 11 is movable to take one of two possible positions, i.e. a first position (shown in FIGS. 3 and 4A) in which the stapling fork 6 will run along a circular path over the path section 11, and shown in FIG. 4b and indicated by arrow C in FIG. 3, a second position in which the path section is displaced to a laterally oriented position and therewith makes coaction with the wheel 6b of the stapling fork impossible and causes the stapling fork to move along a slightly curved path section 12 which deviates from a circular line and which lowers the upper part of the stapling fork to an extent such as to prevent cutting of the wire-like material and the forming of a U-shaped staple.

The aforesaid activating signal is produced by a control circuit 20 at least during those time periods in which the stapling fork 6 passes the region B, between the stapling cylinder and the forming drum.

In the case of the illustrated embodiment, this activating signal 21 is shown to occur solely when the stapling fork 6 passes the region B, in that an electric contact 28 of the control circuit 20 can be caused to take a closed position by a camming curve, not shown.

Alternatively, and as will be understood, the activating signal can be caused to occur during a full revolution.

The activating signal can also be inverse.

Upon the occurrence of an activating signal on the line 21 extending from the control unit 20 to a pull magnet 22 during each alternate revolution of the stapling cylinder 2, the speed at which the wire 10 is fed from a wire-feeding unit 30 may be chosen to be half the speed at which the wire is fed in the absence of an activating signal, whereas upon the occurrence of an activating signal 21 during two sequential revolutions of said cylinder, the speed at which the wire 10 is fed may be chosen to be one-third of the speed at which the wire is fed in the absence of an activating signal, and so on.

Referring back to FIGS. 4A and 4B, it will be seen that the first path section 11 and the second path section 12 are comprised of generally parallel, narrow path sections of which the first path section 11 is movable between a position in which it is proximate to the second path section 12 and a position in which it is distanced from said path section 12.

The stapling fork 6 thus runs on a broad runner 6b throughout a full rotation of the stapling cylinder along a circular (or a generally circular) guide path 13, which is either augmented with a narrow path section 11 or a path section 12 in the aforesaid region B.

Finally, it will be seen from FIG. 3 that a pull magnet 22 coacts with a lever 23 which is pivotally mounted on a shaft 24, wherein the lower part of the lever 23 coacts with a rod 25 which is fixedly connected to a segment 26 whose upper surface forms said path section 11.

The segment 26 carrying the path section 11 takes in FIG. 3 the position shown in FIG. 4A and is urged towards this position by a spring device 27.

Figure 5:
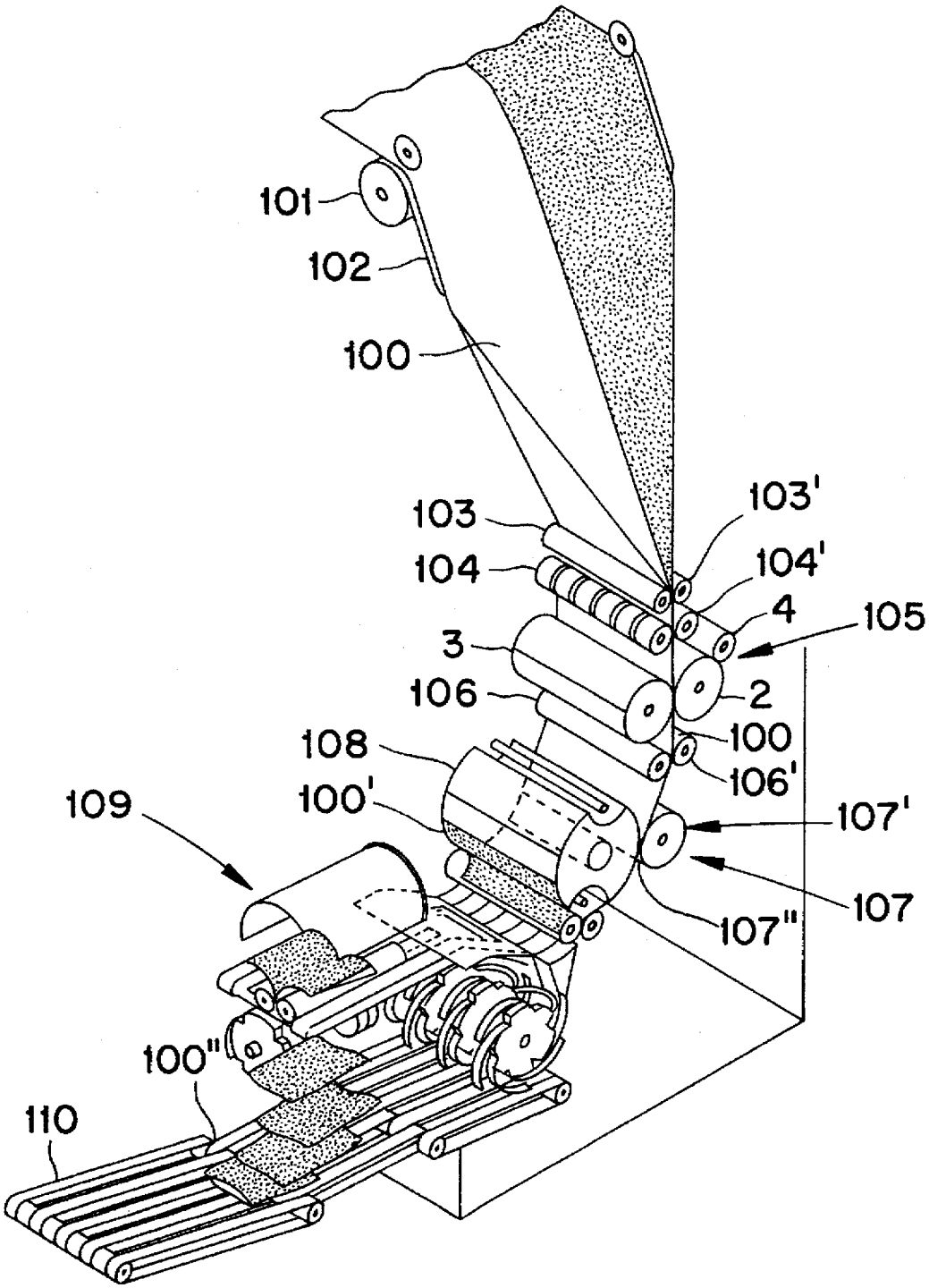

In order to illustrate the practical use of a machine of the inventive embodiment on-line in a printing press FIG. 5 discloses a previously known printing press with paper folding means arranged upstreams the machine and downstreams the machine.

It is here disclosed the a printed continous paper web 100 or path is running over a roller 101. The web 100 is folded in the middle by a wedge means 102 and is feed double-folded between two rollers 103, 103' and two feeding rollers 104, 104'.

The paper web can be folded many times in such a way that the folded web has the pages in a successive or sequential order with half of the pages on one side and the other half of the pages on the other side the folded web is transported to an on-line or integrated Rotary Stapling Machine 105, having the rollers 2, 3 and 4 arranged as illustrated in FIG. 1, whereby two staples can be attached to the folded paper web to the region intended to be the back of the printed publication.

Hereafter the folded and staple attached paper web 100 is passing two rollers 106, 106' and to a cutting means 107, having a roller 107' and a knife 107".

The thus cutted paper web 100' and the printed publication is now folded once again of a roller 108 along a line defined by the orientation of the staples and can so folded be transported to a further folding means 109 and the completed folded publication; such as newspaper 100" can be transported with the use of a conveyor 110.

It will be understood that the invention is not restricted to the described and illustrated exemplifying embodiments thereof and that modifications can be made within the scope of the inventive concept as defined in the following claims.

I claim:

1. A device for applying staples to a material at predetermined distances along a web formed by the material, comprising:

a stapling cylinder;

a counterpressure cylinder positioned to rotate adjacent to the stapling cylinder with the web passing therebetween;

a forming drum positioned to rotate adjacent to the stapling cylinder;

a horn which extends around a periphery of the stapling cylinder between the forming drum and the counterpressure cylinder;

a stapling fork carried by the stapling cylinder, the stapling fork coacting with the stapling cylinder to cut a staple-forming section from wire material in a region between the stapling cylinder and the forming drum and to form from said staple-forming section a U-shaped staple, wherein rotation of the stapling cylinder carries the U-shaped staple to a region between the stapling cylinder and the counterpressure cylinder for fastening the U-shaped staple to the material web passing between said stapling cylinder and said counterpressure cylinder;

means for generating an activating signal selectably responsive to a rotation of the stapling cylinder;

a guide element mounted adjacent to the stapling cylinder for guiding the stapling fork, the guide element defining a guide path including a selectable first path section and a selectable second path section; and, means for selecting one of said first path section and second path section for the guide path in response to said activating signal, wherein the stapling fork is movable along the first path section in the region between the stapling cylinder and the forming drum to cut and form a staple, and wherein the stapling fork is movable along the second path section in the region between the stapling cylinder and the forming drum to prevent cutting of said wire material and the formation of a U-shaped staple.

2. A device according to claim 1, comprising a control circuit for producing said activating signal when the stapling fork passes the region between the stapling cylinder and the forming drum.

3. A device according to claim 1, further comprising means for feeding wire material for staples at a controllable rate including a base feed rate, said means being responsive to the activating signal, wherein upon generation of the activating signal on alternate revolutions of the stapling cylinder causes the feed rate to be adjusted to half of the base feed rate, and upon generation of the activating signal on two mutually sequential revolutions of the stapling cylinder causes the feed rate to be adjusted to one-third of the base rate.

4. A device according to claim 1, wherein the first path section and the second path section are are disposed in the guide element as parallel path sections, and wherein the first path section is movable between a position in which it is proximate to the second path section and a position in which it is distanced from said second path section.

5. A device according to claim 1, wherein the stapling fork includes a runner that moves on the guide element as the stapling cylinder rotates, and wherein, responsive to the activating signal, the runner contacts one of first path section or the second path section.

6. A device according to claim 1, wherein the first path section comprises a body having a surface, the body being movable between a lateral position in which the stapling fork moves along the second path section to prevent cutting of the wire-like material and the formation of a U-shaped staple, and an aligned position in which the stapling fork moves along the first path section so that the wire-like material is cut and a U-shaped staple is formed.

7. A device according to claim 6, comprising a control circuit for producing said activating signal during time period in which the stapling fork passes the region between the stapling cylinder and the forming drum.

8. A device according to claim 1, wherein the second path section comprises a surface which deviates from a circular line of the guide element and is directed toward a central part of the stapling cylinder.

9. A device according to claim 2, comprising a control circuit for producing said activating signal during time period in which the stapling fork passes the region between the stapling cylinder and the forming drum.

10. A device according to claim 2, the first path section comprises a body having a surface, the body being movable between a lateral position in which the stapling fork moves along the second path section which prevents cutting of the wire-like material and the formation of a U-shaped staple, and an aligned position in which the stapling fork moves along the first path section so that the wire-like material is cut and a U-shaped staple is formed.

11. A device according to claim 10, comprising a control circuit for producing said activating signal during time period in which the stapling fork passes the region between the stapling cylinder.

* * * * *